US005245712A

United States Patent [19]

Laughton

[11] Patent Number: 5,245,712

[45] Date of Patent: Sep. 21, 1993

[54] TILE EDGE TUB

[75] Inventor: John Laughton, Bedminster, N.J.

[73] Assignee: American Standard Inc., New York, N.Y.

[21] Appl. No.: 877,363

[22] Filed: May 1, 1992

Related U.S. Application Data

[63] Continuation of Ser. No. 570,748, Aug. 22, 1990, abandoned.

[51] Int. Cl.[5] ..... A47K 3/16

[52] U.S. Cl. ..... 4/595

[58] Field of Search ..... 4/538, 584, 592, 595, 4/631, 632, 633, 634, 635, 636

[56] References Cited

U.S. PATENT DOCUMENTS

| | | | |
|---|---|---|---|
| 555,560 | 3/1896 | Burnap | 4/584 |
| 2,054,146 | 9/1936 | Troeger et al. | 4/584 |
| 2,094,782 | 10/1937 | Doherty | 4/538 X |
| 2,883,677 | 4/1959 | Geen | 4/636 |
| 3,020,561 | 2/1962 | Cotting | 4/595 |
| 4,771,488 | 9/1988 | Markham | 4/631 |

FOREIGN PATENT DOCUMENTS

| | | | |
|---|---|---|---|
| 2900833 | 7/1980 | Fed. Rep. of Germany | 4/635 |
| 0546254 | of 1956 | Italy | 4/632 |
| 88/05280 | 7/1988 | PCT Int'l Appl. | 4/584 |

OTHER PUBLICATIONS

Eljer Company Catalog, A Household International Company Form No. 911-5110-00, Printed in USA Apr. 1986.

*Primary Examiner*—William A. Cuchlinski, Jr.
*Assistant Examiner*—John L. Beres
*Attorney, Agent, or Firm*—Blum Kaplan

[57] ABSTRACT

A bathtub adapted to be secured in an opening defined by a tiled horizontal surface. The tub includes a sump portion having a bottom wall and an upstanding wall having a lower edge joined to said bottom wall and an upper edge. An essentially flat horizontal planar surface extends outwardly from the upper edge of the sidewall. The horizontal planar surface has a finished appearance and a selected thickness so that the planar surface rests flush with the tiled horizontal surface.

3 Claims, 1 Drawing Sheet

TILE EDGE TUB

This is a continuation of U.S. Pat. application Ser. No. 07/570,748, filed on Aug. 22, 1990, for TILE EDGE TUB now abandoned.

BACKGROUND OF THE INVENTION

This invention relates generally to a bathtub, and, in particular, to a bathtub having a flat tile edge rim which is installed such that the tub rim is flush with a horizontal tiled surface.

In general, conventional tubs include a sump portion and an upper rim extending therearound which includes a downwardly depending skirt. Such prior art tubs having drop edge sides require tile and grout to be formed up to the sides of the sump portion of the tub creating problems for cleanability and access. In addition, since the tiled surface extends to the side of the tub, the tiles may form sharp edges and provide an unseemly appearance. Further, the construction of the prior art readily allows water to seep under the tile causing the grout to deteriorate and the tile to become loose.

Accordingly, it is desired to provide a bathtub with a new rim configuration which allows the installation of a bathtub into a receiving region such that the tub rim is flush with the tiled surface.

SUMMARY OF THE INVENTION

Generally speaking, in accordance with the present invention, a bathtub having a tile edge configuration is provided. The bathtub includes a sump portion having a bottom wall integrally formed with a surrounding sidewall. The sidewall has a lower end coupled to bottom wall forming the sump portion and an upper end. An essentially horizontal planar surface extends outwardly from the upper end of the sidewall forming the tile edge region of the tub. Upon insertion of the bathtub into a receiving region, the horizontal planar surface lies flush with the area to be tiled.

Accordingly, it is an object of the present invention to provide an improved bathtub have a tile edge surface.

Another object of the present invention is to provide a bathtub with improved access.

Yet another object of the present invention is to provide a bathtub having a smoother appearance and improved cleanability.

Still another object of the invention is to provide a bathtub to be inserted into a receiving region such that the tub rim is flush with a tiled surface.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompany drawings, in which.

DETAILED DESCRIPTION OF THE PREFERRED EMBODIMENTS

Figure 1:
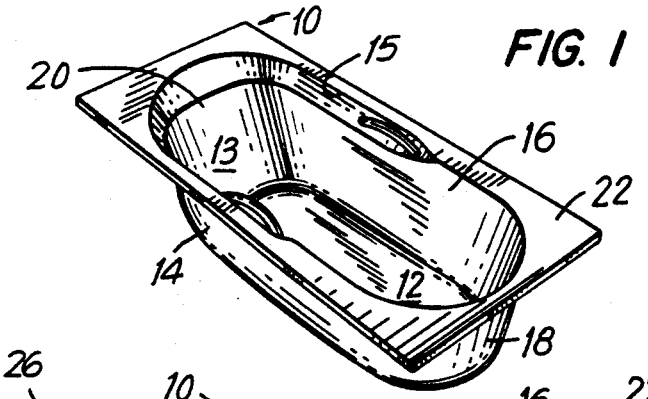
FIG. 1 is a perspective view of a tile edge tub constructed in accordance with a preferred embodiment of the present invention.
Figure 2:
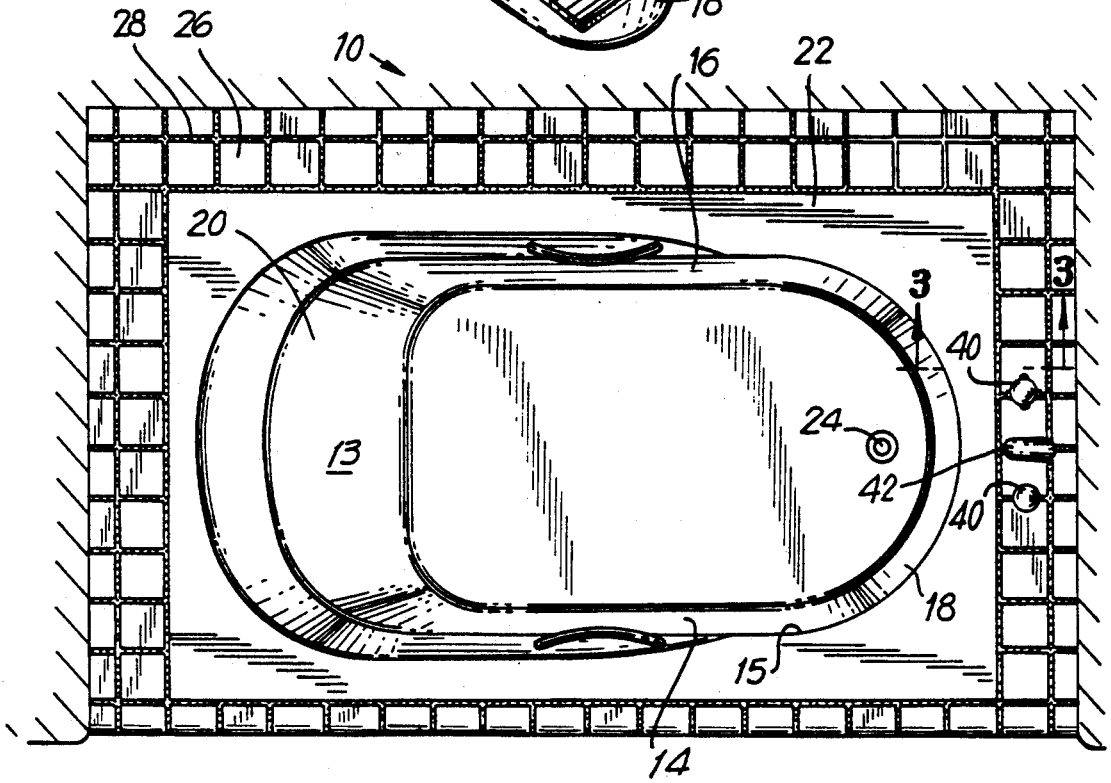
FIG. 2 is a top plan view of the tile edge tub depicted in FIG. 1 shown secured in a tiled receiving region.
Figure 3:
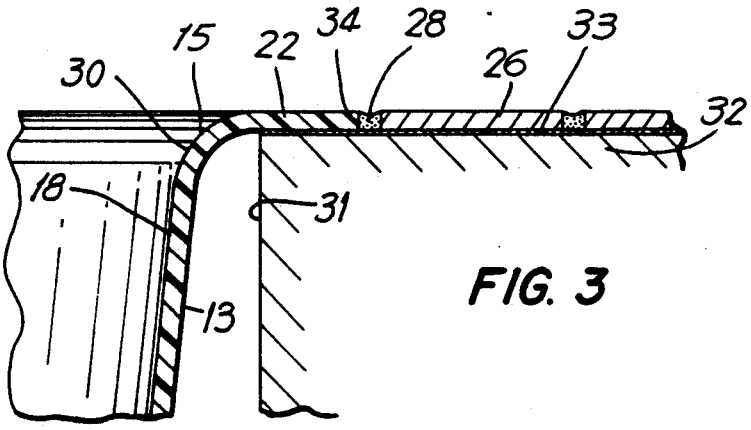
FIG. 3 is an enlarged sectional view taken along line 3—3 of FIG. 2.

Reference is made to FIGS. 1-3 of the drawings which depict a tile edge tub, generally indicated at 10, and constructed in accordance with a preferred embodiment of the present invention. As depicted, tile edge tub 10 is generally an elongated rectangular shape. while such shape finds most utility in normal installations, the present invention is not limited to such shape. Tile edge tub 10 may be formed in triangular, square, round or other appropriate configurations.

Tile edge tub 10 includes a bottom portion 12 with a surrounding sidewall 13 including longer opposing sides 14 and 16 and shorter opposing sides 18 and 20. Sidewall 13 is integrally formed with bottom 12 to form the sump portion of the tub. Bottom 12 is further provided with a drain opening 24.

Extending outwardly from upper edge 15 of sidewall 13 is an essentially flat horizontal planar surface 22 terminating in a free edge portion 34. Planar surface 22 has a finished appearance and a thickness which permits it to be flush with a tiled surface as described below.

In installation, tub 10 is inserted into an opening 31 defined by support structure 32 having an upper horizontal surface 33. Referring specifically to FIG. 3, horizontal planar surface 22 is shown extending outwardly from tub side 18 wherein the joined region has a rounded surface 30. Upon insertion of tile edge tub 10, horizontal planar surface 22 rests on upper horizontal surface 33 of support structure 32. Horizontal planar surface 22 rests atop support structure 32 at a level essentially flush with the height of tiles 26 also supported thereon. As shown in FIG. 3, tile 26 is placed near the edge portion 34 of horizontal planar surface 22.

In order to finish the installation, grout 28 is used to fill the voids. Grout 2 is inserted between tile 26 and edge portion 34 of horizontal planar surface 32 to form a tight seal so that tile edge tub 10 is sealed in place. Further, since end portion 34 is joined to tile 26 by grout 28, a tight water seal is formed therebetween.

Tile edge tub 10 is preferably formed from cast iron and has an enamel finish with a thickness corresponding to the thickness of tile 26. However, fiber glass or any other material may be used in the construction to form the present invention so long as the desired thickness is maintained. Further, the sump portion of tile edge tub 10 can be constructed to include an integral lumbar support and a beveled headrest. In addition, the tile edge tub may be constructed with a slip resistant surface, removable grab bars or any other features usually associated with a whirlpool system or bathtub.

In the preferred embodiment, hot and cold faucets 40 and spout 42 extend from the tiled area of the receiving region through support structure 32. In this configuration, the spout extends over horizontal planar surface 22 so that the water may flow into tub 10. In an alternative embodiment, openings may be cut out from the horizontal planar surface 22 so that the piping for the faucets and spout may extend therethrough forming an integral plumbing and tub configuration.

Accordingly, a tile edge bathtub is provided with a horizontal planar surface to allow installation of the bathtub into a tiled surface. The construction allows the tub to be inserted so that the tub rim is flush with the tiled surface thereby improving access, appearance and cleanability.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described and all statements of the scope of the invention which, is a matter of language, might be said to fall therebetween.

What is claimed is:

1. A bathtub adapted to be secured in an opening defined by an upper horizontal surface with a tiled horizontal surface having tiles of a selected thickness, comprising a sump portion, sized to receive the body of an adult, having a bottom wall and an upstanding sidewall having a lower edge joined to said bottom wall and an upper edge, and an essentially flat horizontal planar surface having no upstanding flanges and extending outwardly from said upper edge of said sidewall, said essentially flat horizontal planar surface having a finished appearance and essentially the selected thickness of said tiled horizontal surface so that said horizontal planar surface rests essentially flush with said tiled horizontal surface when inserted into said opening therein, said horizontal planar surface resting on and being supported by said upper horizontal surface, said horizontal planar surface forming a tight grout seal between said horizontal planar surface and said tiled surface, said sump portion including at least one grab bar for assisting in entering and exiting said sump portion, a faucet supported on said tiled horizontal surface, and a spout extending from said tiled horizontal surface and extending over said horizontal planar surface to permit water controlled by said faucet to flow from said spout into said sump portion.

2. The bathtub of claim 1, wherein said horizontal plannar surface has a rounded edge where joined to said sidewall.

3. The bathtub of claim 1, wherein said bathtub is formed of cast iron having an enamel coating thereon.

* * * * *